US010730675B2

(12) United States Patent
Bates et al.

(10) Patent No.: US 10,730,675 B2
(45) Date of Patent: Aug. 4, 2020

(54) CARTON AND CARTON BLANK

(71) Applicant: WestRock Packaging Systems, LLC, Atlanta, GA (US)

(72) Inventors: Aaron L. Bates, Kennesaw, GA (US); Caleb S. Loftin, Richmond, VA (US); Nathaniel B. Ball, Richmond, VA (US); Brandon L. Ramsuer, Henrico, VA (US)

(73) Assignee: WestRock Packaging Systems, LLC, Atlanta, GA (US)

( * ) Notice: Subject to any disclaimer, the term of this patent is extended or adjusted under 35 U.S.C. 154(b) by 0 days.

(21) Appl. No.: 16/245,350

(22) Filed: Jan. 11, 2019

(65) Prior Publication Data

US 2019/0144183 A1 May 16, 2019

Related U.S. Application Data

(62) Division of application No. 14/786,404, filed as application No. PCT/US2014/035197 on Apr. 23, 2014, now abandoned.

(Continued)

(51) Int. Cl.
*B65D 71/36* (2006.01)
*B65D 5/46* (2006.01)

(Continued)

(52) U.S. Cl.
CPC ..... *B65D 71/36* (2013.01); *B65D 5/443* (2013.01); *B65D 5/46192* (2013.01); *B65D 5/542* (2013.01); *B65D 2571/0058* (2013.01); *B65D 2571/0066* (2013.01); *B65D 2571/00141* (2013.01); *B65D 2571/00462* (2013.01);

(Continued)

(58) Field of Classification Search
CPC .... B65D 71/36; B65D 5/443; B65D 5/46192; B65D 5/542; B65D 2571/00141; B65D 2571/00462; B65D 2571/00469; B65D 2571/00524; B65D 2571/00543;

(Continued)

(56) References Cited

U.S. PATENT DOCUMENTS 2,916,196 A * 12/1959 Kramer ..... B65D 5/46192 229/117.12
3,216,645 A * 11/1965 Hemann ..... B65D 5/46016 229/117.13

(Continued)

FOREIGN PATENT DOCUMENTS

GB 2234495 2/1991

*Primary Examiner* — Andrew D Perrault
(74) *Attorney, Agent, or Firm* — WestRock Intellectual Property Group

(57) ABSTRACT

A carton includes a top wall (12*a*/12*b*), first side wall (14), second side wall (18), first end wall, a second end wall and a bottom wall (16). The carton has a handle structure (H) defined at least in part in an outer panel (12*b*) and at least in part in an inner panel (12*a*). The outer panel is disposed in overlapping relationship with the inner panel to form the top wall. The outer panel includes an outer handle strap (30) while the inner panel includes an inner handle strap (32). The outer handle strap is continuously formed with the outer panel at its first end and severably attached to the outer panel at its second end by a frangible connection (46). The inner handle strap includes a first end disposed in the inner panel and continuously formed with the inner panel.

10 Claims, 10 Drawing Sheets

Related U.S. Application Data

(60) Provisional application No. 61/815,057, filed on Apr. 23, 2013.

(51) Int. Cl.
*B65D 5/44* (2006.01)
*B65D 5/54* (2006.01)

(52) U.S. Cl.
CPC ..... *B65D 2571/00469* (2013.01); *B65D 2571/00524* (2013.01); *B65D 2571/00543* (2013.01); *B65D 2571/00561* (2013.01); *B65D 2571/00728* (2013.01)

(58) Field of Classification Search
CPC .. B65D 2571/00561; B65D 2571/0058; B65D 2571/0066; B65D 2571/00728
USPC ..... 206/428; 229/117.13, 117.14
See application file for complete search history.

(56) References Cited

U.S. PATENT DOCUMENTS

| | | | | |
|---|---|---|---|---|
| 4,588,084 | A * | 5/1986 | Holley, Jr. ..... | B65D 71/36 206/427 |
| 5,639,017 | A | 6/1997 | Fogle | |
| 6,065,590 | A | 5/2000 | Spivey | |
| 6,425,520 | B1 | 7/2002 | Peterson | |
| 8,220,702 | B2 | 7/2012 | DeBusk et al. | |
| 10,214,333 | B2 * | 2/2019 | Ball ..... | B65D 71/12 |
| 10,569,947 | B2 * | 2/2020 | Ball ..... | B65D 75/06 |
| 2002/0079356 | A1 | 6/2002 | Chargueraud | |
| 2005/0247767 | A1 | 11/2005 | Smalley | |
| 2007/0181658 | A1 | 8/2007 | Sutherland | |
| 2008/0067223 | A1 * | 3/2008 | Jego ..... | B65D 71/30 229/117.13 |
| 2012/0012600 | A1 | 1/2012 | Gonzalez | |
| 2017/0297796 | A1 * | 10/2017 | Ball ..... | B65D 5/46 |
| 2019/0144182 | A1 * | 5/2019 | Ball ..... | B65D 71/36 229/117.13 |

* cited by examiner

CARTON AND CARTON BLANK

PRIORITY

This application is a Divisional Application of U.S. patent application Ser. No. 14/786,404 filed Oct. 22, 2015, which is a 371 Application of International Patent Application No. PCTUS14035197 filed Apr. 23, 2014, which claims the benefit of U.S. Provisional Patent Application No. 61/815,057 filed Apr. 23, 2013, all of which are incorporated herein by reference in their entirety.

FIELD OF THE INVENTION

The present invention relates to a carton and blank for forming a carton, more specifically, but not exclusively to a carton having a carrying handle and a dispenser.

BACKGROUND OF THE INVENTION

In the field of packaging it is often required to provide consumers with a package comprising multiple primary product containers. Such multi-packs are desirable for shipping and distribution and for display of promotional information. For cost and environmental considerations, such cartons or carriers need to be formed from as little material as possible and cause as little wastage in the materials from which they are formed as possible. Another consideration is the strength of the packaging and its suitability for holding and transporting large weights of articles.

It is desirable to provide multi-packs with a carrying handle for a user to carry the multi-pack and a dispenser or an access means for a user to remove the primary product containers from the multi-pack.

The present invention seeks to overcome or at least mitigate the problems of the prior art.

SUMMARY OF INVENTION

According to a first aspect of the present invention there is provided a carton for packaging one of more articles, comprising a plurality of walls including a top wall, a first side wall, a second side wall, a first end wall, a second end wall and a bottom wall, the carton having a handle structure defined at least in part in an outer panel of one of the plurality of walls and at least in part in an inner panel of the one of the plurality of walls, the outer panel being disposed in at least partially overlapping relationship with the inner panel to form the one of the plurality of walls, the outer panel comprising an outer handle strap, the inner panel comprising an inner handle strap, the outer handle strap being continuously formed with the outer panel at a first end and severably attached by a frangible connection to the outer panel at a second end, opposing the first end, the inner handle strap comprising a first end disposed in the inner panel and continuously formed with the inner panel, the inner handle strap comprising a second end disposed in a third panel of another one of the plurality of walls, the outer handle strap being secured to the inner handle strap, the handle structure having a central portion defined by the outer handle strap which central portion is displaceable out of the plane of the one of the plurality of walls upon severance of said frangible connection, the carton further comprising an access device struck at least in part from the one of the plurality of walls, the access device being disposed adjacent to the first end of the outer handle strap.

Advantageously the handle structure and the access device can be employed either independently or together.

Optionally, the handle structure comprises a reinforcing strap.

Preferably, the reinforcing strap is hinged to the inner handle strap and is secured to the inner handle strap in face contacting relationship.

Optionally, the reinforcing strap is struck at least in part from the inner panel.

In some embodiments, the third panel forms a first end closure panel of the another one of the plurality of walls and wherein the carton further comprises a first side end closure panel forming in part the another one of the plurality walls, the first side end closure panel having a first cutaway portion configured and arranged to expose a portion of the inner handle strap that is disposed in the first end closure panel.

Optionally, the carton further comprises a second side end closure panel forming in part the another one of the plurality of walls, the second side end closure panel having a second cutaway portion configured and arranged to expose the portion of the inner handle strap disposed in the first end closure panel.

Preferably, the first cutaway portion and the second cutaway portion define a recess which exposes the portion of the inner handle strap that is disposed in the first end closure panel.

Optionally, the one of the plurality of walls comprises the top wall, and the access device comprises a detachable portion of the top wall.

Preferably, the access device further comprises a detachable portion of the first side wall, the second side wall and the second end wall so as to form a removable corner portion.

Alternatively, the one of the plurality of walls comprises at the top wall, and the access device comprises a detachable portion of the first side wall, second side wall and second end wall so as to form a removable portion.

Alternatively, the one of the plurality of walls comprises the top wall, and the access device comprises an aperture defined in the top wall.

According to a second aspect of the present invention there is provided a blank for forming a carton, the blank comprising a plurality of panels for forming a top wall, a first side wall, a second side wall, a first end wall, a second end wall and a bottom wall, in a set-up carton an outer panel of the top wall being disposed in at least partially overlapping relationship with an inner panel of the top wall to form the top wall, the blank further comprising a handle structure defined at least in part in the outer panel and at least in part in the inner panel, the outer panel comprising an outer handle strap, the inner panel comprising an inner handle strap, the outer handle strap being continuously formed with the outer panel at a first end and severably attached by a frangible connection to the outer panel at a second end, opposing the first end, the inner handle strap comprising a first end disposed in the inner panel and continuously formed with the inner panel, the inner handle strap comprising a second end disposed in a third panel of the first end wall, the outer handle strap being arranged to be securable to the inner handle strap, the handle structure having a central portion defined by the outer handle strap which central portion, in a set-up carton, is displaceable out of the plane of the top wall upon severance of said frangible connection, the blank further comprising an access device defined, at least in part in the outer panel and at least in part, in the inner panel, the access device being disposed adjacent to the first end of the first hand strap.

Within the scope of this application it is envisaged and intended that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Exemplary embodiments of the invention will now be described with reference to the accompanying drawings, in which.

DETAILED DESCRIPTION OF EXEMPLARY EMBODIMENTS

Detailed descriptions of specific embodiments of the package, blanks and cartons are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and cartons described herein may be embodied in various and alternative forms. The figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
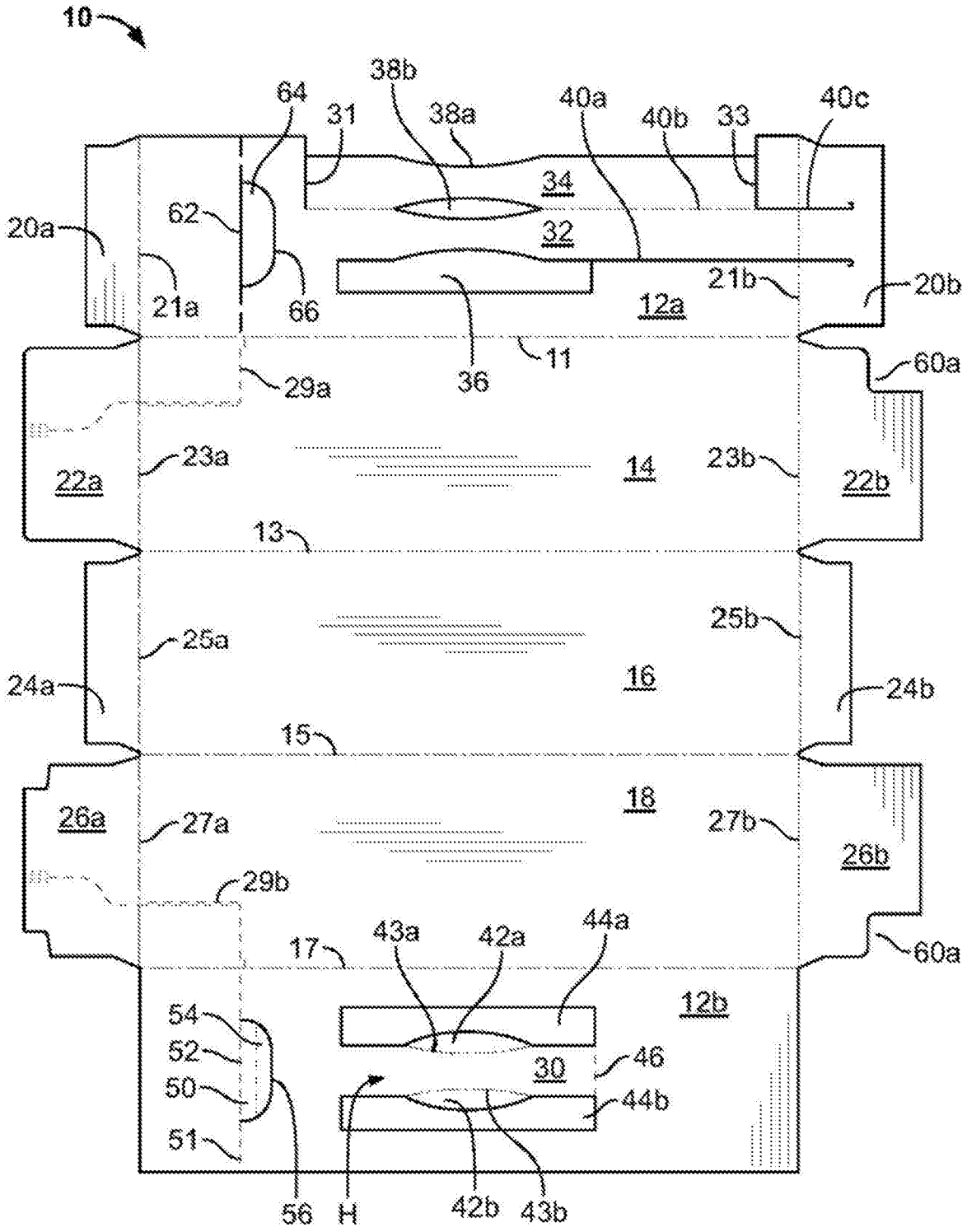
FIG. 1 is a plan view from above of a blank for forming a carton according to a first embodiment of the invention.
Figure 2:
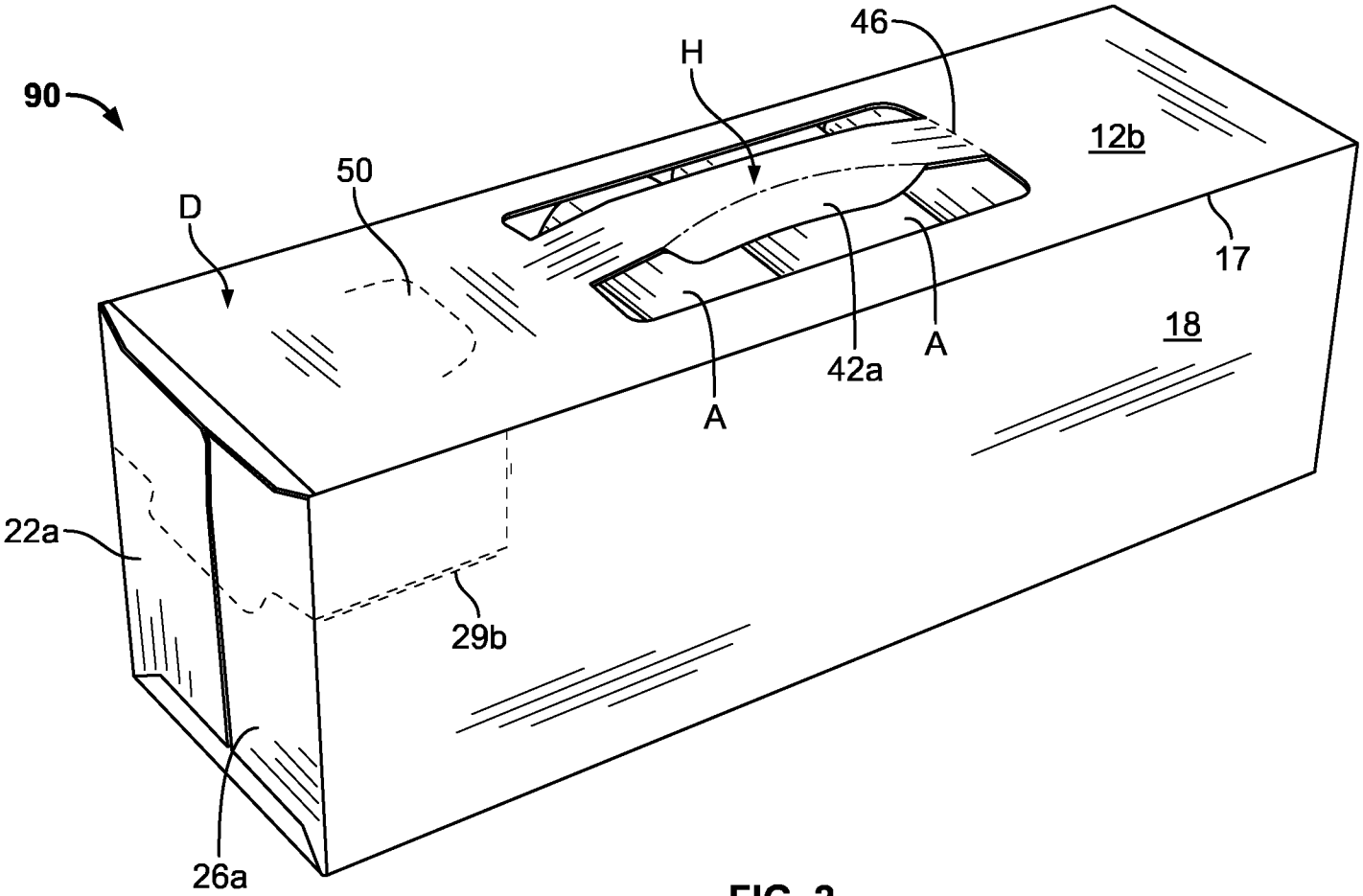
FIG. 2 is a perspective view from above of a first end of the carton formed from the blank of FIG. 1 showing a handle structure in a stowed state.

Referring to FIG. 1 there is shown a plan view of a blank 10 capable of forming a carton 90 for packaging one or more primary products containers, such as, but not limited to, bottles or cans, hereinafter referred to as articles A.

In the embodiments detailed herein, the terms 'carton' and 'carrier' refer, for the non-limiting purpose of illustrating the various features of the invention, to a container for engaging, carrying, and/or dispensing articles, such as product containers. It is contemplated that the teachings of the invention can be applied to various product containers, which may or may not be tapered and/or cylindrical. Exemplary containers include bottles (for example metallic, glass or plastics bottles), cans (for example aluminium cans), tins, pouches, packets and the like.

The blanks 10, 110, 210 are formed from a sheet of suitable substrate. It is to be understood that, as used herein, the term "suitable substrate" includes all manner of foldable sheet material such as paperboard, corrugated board, cardboard, plastic, combinations thereof, and the like. It should be recognized that one or other numbers of blanks may be employed, where suitable, for example, to provide the carrier structure 90 or 290 described in more detail below.

In the exemplary embodiments, the blank 10, 110 are configured to form a carton or carrier 90 for packaging an exemplary arrangement of exemplary articles. In a first illustrated exemplary embodiment, the arrangement is a 2×6 matrix or array and the articles A are cans. In a second illustrated exemplary embodiment, the arrangement is a 3×6 matrix or array and the articles A are cans. The blanks 10, 110 can be alternatively configured to form a carrier for packaging other types, number and size of article and/or for packaging articles in a different arrangement or configuration.

The blank 10 comprises a plurality of main panels 12*a*, 12*b*, 14, 16, 18 for forming: a second top panel 12*a*, a first side wall 14, a bottom wall 16, a second side wall 18 and a first top panel 12*b* in set-up carton 90. The second top panel 12*a* is hinged to the first side wall 14 by a fold line 11. The first side wall 14 is hinged to the bottom wall 16 by a fold line 13. The bottom wall 16 is hinged to the second side wall 18 by a fold line 15. The first top panel 12*b* is hinged to the second side wall 18 by a fold line 17.

The plurality of main panels 12*a*, 12*b*, 14, 16, 18 form a tubular structure in a set-up condition. Each of the ends of the tubular structure are at least partially closed by end closure panels 20*a*, 22*a*, 24*a*, 26*a* and 20*b*, 22*b*, 24*b*, 26*b*. End closure panels 20*a*, 22*a*, 24*a*, 26*a* are configured to form a first end wall to close, at least in part, a first end of the tubular structure and end panels 20*b*, 22*b*, 24*b*, 26*b* are configured to form a second end wall to close, at least in part, a second end of the tubular structure. A first end closure panel 20*a* is hinged to a first end of the second top panel 12*a* by a fold line 21*a*. A second end closure panel 22*a* is hinged to a first end of the first side wall 14 by a fold line 23*a*. A third end closure panel 24*a* is hinged to a first end of the bottom wall 16 by a fold line 25*a*. A fourth end closure panel 26*a* is hinged to a first end of the second side panel 18 by a fold line 27*a*.

A fifth end closure panel 20*b* is hinged to a second end of second top panel 12*a* by a fold line 21*b*. A sixth end closure panel 22*b* is hinged to a second end of first side wall 14 by a fold line 23*b*. A seventh end closure panel 24*b* is hinged to a second end of bottom wall 16 by a fold line 25*b*. An eighth end closure panel 26*b* is hinged to a second end of the second side wall 18 by a fold line 27*b*.

A handle structure H is provided in part by respective portions of the second top panel 12*a* and the first top panel 12*b*. The handle structure H comprises an outer handle strap 30 defined in part by a first aperture 44*a* struck from the first top panel 12*b* and in part by a second aperture 44*b* struck from the first top panel 12*b*. The outer strap 30 comprises a first cushioning flap 42*a* hinged to a first side thereof by a fold line 43*a* and a second cushioning flap 42*b* hinged to a second side, opposing the first side, of the outer strap 30 by a fold line 43*b*. A weakened line of severance 46 extends transversely across the outer strap 30 between the first aperture 44*a* and the second aperture 44*b*. The weakened line of severance 46 defines a first end of the outer strap 30. The opposite end of the outer strap 30 is continuous with the first top panel 12*b*. Continuous is intended to include integrally formed and uninterrupted. Preferably, the material at the end of the outer strap 30 is unitary with the material of the first top panel 12*b*.

The handle structure comprises an inner handle strap 32 struck in part form the second top panel 12*a* and in part from the fifth end closure panel 20*b*. The inner strap 32 is defined in part by a third aperture 36 (that is struck from the second top panel 12*a*) and in part by a cut line 40*a*. Cut line 40*a* is contiguous with aperture 36 and extends from aperture 36 through the second top panel 12*a* and into the fifth end closure panel 20*b*. Inner strap 30 is also defined in part by a fourth aperture 38*b* and in part by a fold line 40*b*. Fold line 40*b* is interrupted by the fourth aperture 38*b*. The inner strap 32 is also defined in part by a second cutline 40*c* which is defined in part in second top panel 12*a* and in part in the fifth end closure panel 20*b*. The second cutline 40*c* is contiguous with fold line 40*b* and collinear therewith.

A reinforcing strap 34 is hinged to a portion of the inner strap 32 struck from the second top panel 12*a*. The reinforcing strap 34 is hinged to the inner strap 32 by the fold line 40*b*. The fourth aperture 38*b* defines a recess or rebated portion of in the inner strap 32 and in a recess or rebated portion of in the reinforcing strap 34, which is apparent when the reinforcing strap 34 is folded about the fold line 40*b* and disposed in overlapping relationship with a portion of the inner strap 32.

A first cut line 31 defines a first end of the reinforcing strap 34 and a second cut line 33 defines a second end of the reinforcing strap 34. The first and second cut lines 31, 33 extend from a respective end of fold line 40*b* and are substantially perpendicular thereto.

An access device D is provided for removal of a corner portion D of the carton 90 (see FIGS. 2 to 5), the corner portion separates a portion of the first and second top panels 12*a*, 12*b* from the carton 90.

The access device D comprises a first weakened line of severance 29*a* which extends across the second end closure panel 22*a* and into the first side wall 14. The first weakened line of severance 29*a* extends through the first side wall 14 to meet the fold line 11 between the first side wall 14 and the second top panel 12*a*.

The access device D further comprises a second weakened line of severance 29*b* which extends across the fourth end closure panel 26*a* and into the second side wall 18. The second weakened line of severance 29*b* extends through the second side wall 18 to meet the fold line 17 between the second side wall 18 and the first top panel 12*b*. The access device D comprises a third weakened line of severance 51 which extends transversely across the first top panel 12*b*. The third weakened line of severance 51 is arranged to be contiguous with the second weakened line of severance 29*b*. The access device D comprises a fourth weakened line of severance 62 which extends transversely across the second top panel 12*a*. The fourth weakened line of severance 62 is arranged to be contiguous with the first weakened line of severance 29*a*. The third and fourth weakened lines of severance 51, 62 are arranged to be in overlying registry in the set-up up carton 90. In an assembled carton 90 the first, second and third weakened lines of severance 29*a*, 29*b*, 51 form a continuous loop which defines a removable corner portion D of the carton 90.

The access device D also comprises an optional finger engagement or tear initiation means. The tear initiation means comprises a tab 50 defined in the first top panel 12*b*. The tab 50 is defined part by a fold line 52. Fold line 52 interrupts the third weakened line of severance 51 so as to be contiguous therewith. The tab 50 is defined in part by a cut line or fifth weakened line of severance 56. Fifth weakened line of severance 56 comprises a first and a second end each of which is adjacent to or contiguous with a respective one of the ends of the fold line 52. A further optional fold line 54 is provided across the tab 50 and extends transversely with respect to a tubular axis of the set-up carton 90. An aperture 64 is struck from the second top panel 12*a*. Aperture 64 is contiguous with or interrupts the fourth weakened line of severance 62. The aperture 64 is arranged to be in underlying registry with the tab 50 in a set-up carton 90. Aperture 64 is defined in part by a cut line 66, a portion of which interrupts fourth weakened line of severance 62, which portion is co-linear with the fourth weakened line of severance 62.

Turning to the construction of the carton 90 as illustrated in FIGS. 2, 3, 4 and 5 it is envisaged that the carton 90 can be formed by a series of sequential folding operations in a straight line machine so that the carton 90 is not required to be rotated or inverted to complete its construction. The folding process is not limited to that described below and may be altered according to particular manufacturing requirements.

The carton 90 is formed by folding the reinforcing strap 34 about the fold line 40*b* to underlie the inner strap 32. In alternative embodiments the reinforcing strap 34 may be folded about the fold line 40*b* to overlie the inner strap 32. The second top panel 12*a* and the first side wall 14 are folded about the fold line 13 such that the second top panel 12*a* overlies the second side wall 18 and the first side wall 14 overlies the bottom wall 16. Glue or other adhesive treatment is applied to the second top panel 12*a* and/or to a corresponding area of the first top panel 12*b* to secure the second top panel 12*a* to the first top panel 12*b*. The first top panel 12*b* is folded about fold line 17 such that it overlies the second top panel 12*a*, thus forming a flat collapsed tubular structure. The first top panel 12*b* and the second top panel 12*a* which have been secured together form a composite top wall 12*a*/12*b* of the tubular structure.

The portion of the second top panel 12*a* adjacent to the fifth end closure panel 20*b* which overlies the inner strap 32 is free from adhesive such that the inner strap 32 may move with respect to the first and second top panels 12*b*, 12*a* when the handle structure H is deployed. The outer strap 30 is secured with adhesive or other suitable means to a corresponding section of the inner strap 32 which it overlies.

The flat collapsed tubular structure can be shipped or transported to a converter plant. At the converter plant the flat collapsed tubular structure is opened and erected to form a tubular structure having a substantially square or rectangular cross-sectional shape.

The erected tubular structure is loaded with articles A through one or both open ends. One or more of the end closure panels 20*a*, 22*a*, 24*a*, 26*a*, 20*b*, 22*b*, 24*b*, 26*b* may be folded outwardly to act as funnel to facilitate insertion of the articles A into the carton 90.

Once the articles A are loaded into the tubular structure the ends of the tubular structure are closed. A first end of the tubular structure is closed by folding the first end closure panel 20*a* about fold line 21*a* and folding third end closure panel 24*a* about fold line 25*a*. Glue or other adhesive treatment is applied to an outer surface of the first and third end closure panels 20*a*, 24*a*. In alternative embodiments the glue or adhesive treatment is applied to an inner surface of corresponding region of the second and fourth end closure panels 22*a*, 26*a*. The fourth end closure panel 26*a* is then folded about the fold line 27*a* and secured to the first and third end closure panels 20*a*, 24*a*. Glue or adhesive treatment is applied to an outer surface of the fourth end closure panel 26*a* or to an inner surface of the second end closure panel 22*a*. The second end closure panel 22*a* is then folded about fold line 23*a* and brought into contact with the fourth end closure panel 26*a* such that second end closure panel 22*a* is in overlapping relationship with fourth end closure panel 26*a* and is secured thereto.

A second end of the tubular structure is closed by folding the fifth end closure panel 20*b* about fold line 21*b* and folding seventh end closure panel 24*b* about fold line 25*b*. Glue or other adhesive treatment is applied to an outer surface of the fifth and seventh end closure panels 20*b*, 24*b*. In alternative embodiments the glue or adhesive treatment is applied to an inner surface of a corresponding region of the sixth and eighth end closure panels 22*b*, 26*b*. The eighth end closure panel 26*b* is folded about the fold line 27*b* and secured to the fifth and seventh end closure panels 20*b*, 24*b*. Glue or adhesive treatment is applied to an outer surface of the eighth end closure panel 26*b* or to an inner surface of the sixth end closure panel 22*b*. The sixth end closure panel 22*b* is folded about fold line 23*b* and brought into contact with the eighth end closure panel 26*b* such that a portion of the sixth end closure panel 22*b* is in overlapping relationship with a portion of the eighth end closure panel 26*b* and is secured thereto.

In some embodiments one end of the tubular structure may be closed before loading articles though a remaining open end of the tubular structure.

The assembled carton 90 is shown in FIGS. 2, 3, 4 and 5.

Figure 4:
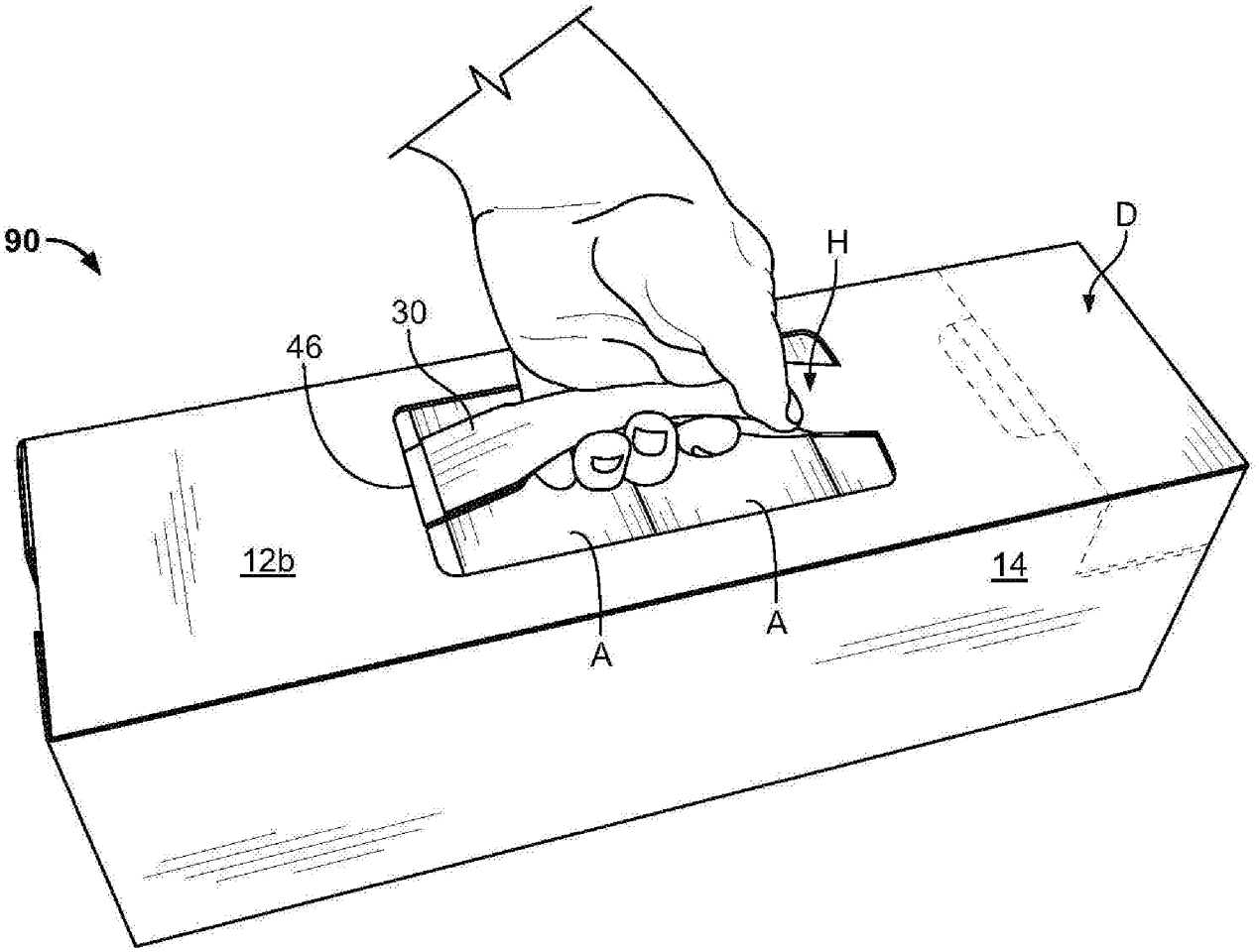
FIG. 4 is a perspective view from above of an end portion of the carton formed from the blank of FIG. 1 showing the handle structure in a deployed state.

A user can engage the handle structure H to carry the carton 90 as shown in FIG. 4. The handle structure H is displaced out of the plane of the first and second top panels 12*b*, 12*a*. The region of the first top panel 12*b* between the fifth end closure panel and the weakened line of severance 46 is disposed over the inner strap 32.

The handle H structure is arranged to be orientated perpendicularly to a tubular axis of the articles A disposed within the carton 90. The handle structure H extends longitudinally along the carton 90, the articles A are arranged so as to be in rolling contact with the bottom wall 16, that is to say the tubular axis of the articles A is arranged to extend transversely within the carton 90.

The tubular axis of the articles A is perpendicular to the first and second side panels 14, 18. Preferably, the articles A are substantially cylindrical in shape, at least in part; this provides voids in the corners or the carton 90 defined by the fold lines 21*a*, 21*b*, 25*a*, 25*b*. The void in the corner defined by fold line 21*b* allows the end of the handle H provided in the fifth end closure panel 20*b* to be displaced inwardly of the carton 90 this allows that the central portion (which includes the outer strap 30) of the handle structure H to be displaced upwardly and outwardly of the plane of the first and second top panels 12*b*, 12*a*.

Figure 3:
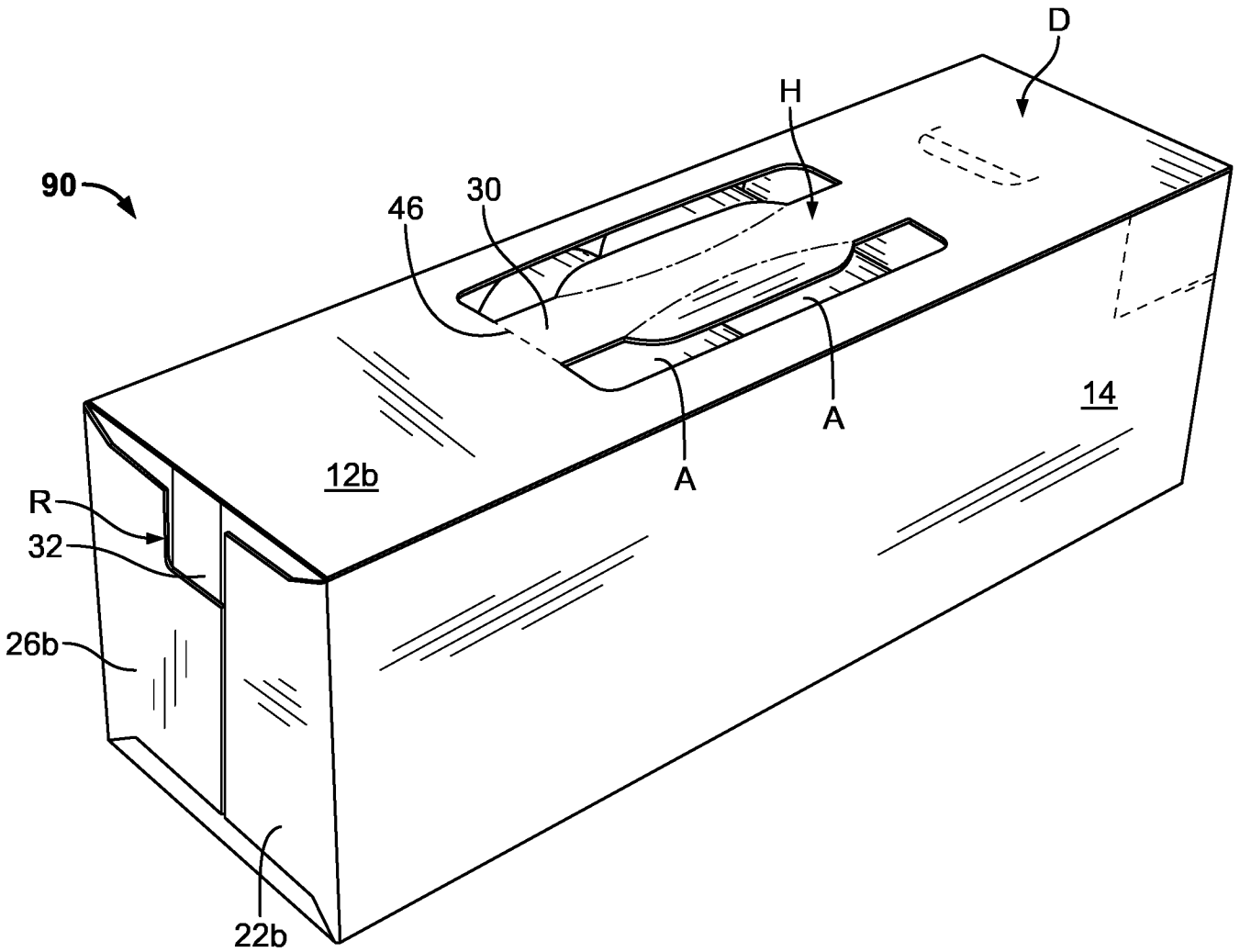
FIG. 3 is a perspective view from above of a second opposite end of the carton formed from the blank of FIG. 1 showing a handle structure in a stowed state.

Referring again to FIG. 1 the sixth end closure panel 22*b* comprises a recessed, rebated or cut away portion 60*a*. The cut away portion 60*a* is disposed in a corner of the sixth end closure panel 22*b* adjacent to the fifth end closure panel 20*b*. The eighth end closure panel 26*b* also comprises a recessed, rebated or cut away portion 60*a* that is disposed in a corner thereof. The cutaway portions 60*a* are arranged so as to coincide when the carton 90 is assembled and the sixth end closure panel 22*b* is disposed in overlapping relationship with the eighth end closure panel 26*b*. FIG. 3 illustrates the cutaway portions 60*a*, 60*b* forming a recess R in the sixth and eighth end closure panels 22*b*, 26*b*. This provides that the sixth and eighth end closure panels 22*b*, 26*b* do not interfere with the end of the inner strap 32 that is disposed in the fifth end closure panel 20*b*.

Figure 5:
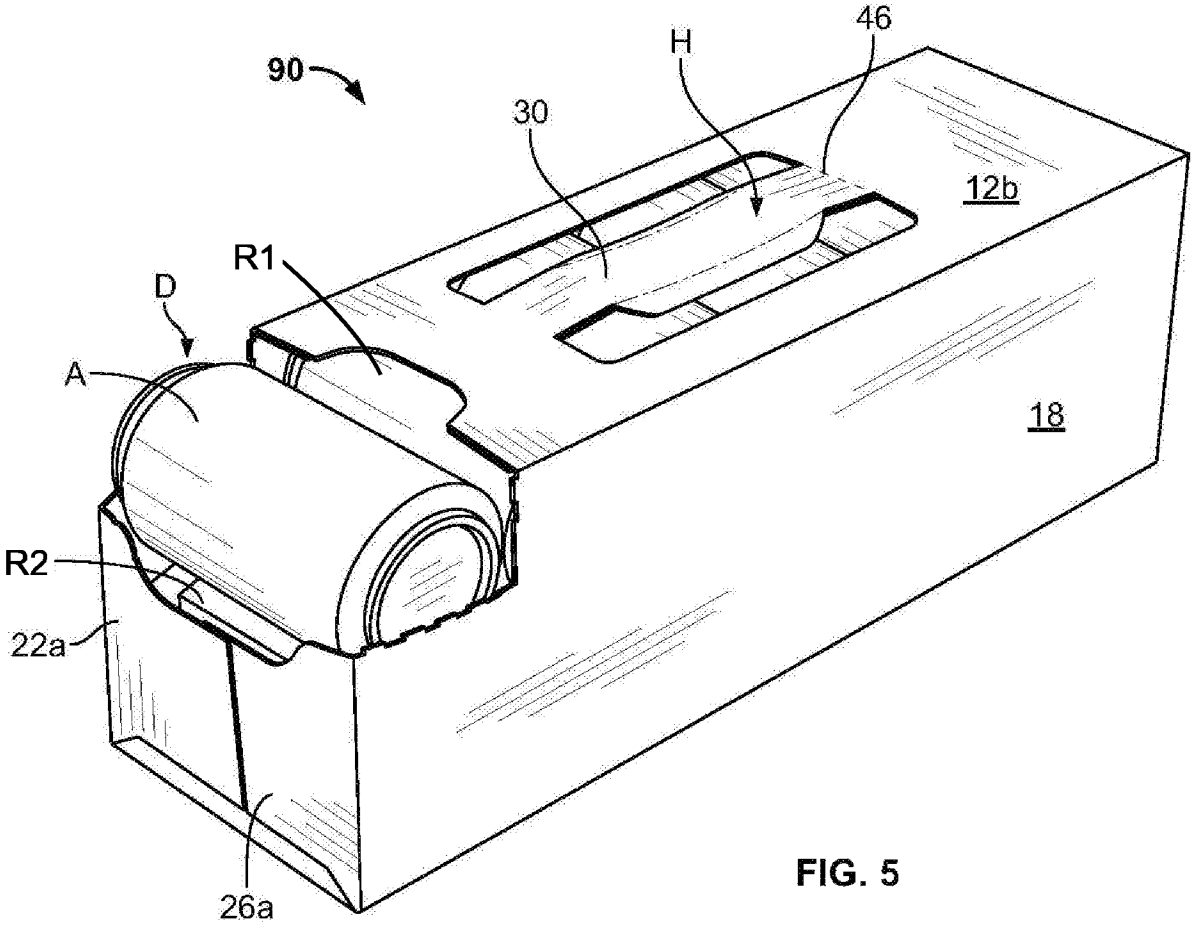
FIG. 5 is a perspective view from above of the carton formed from the blank of FIG. 1 showing the deployment of an access means.

FIG. 5 illustrates use of the access means D, wherein an upper corner portion of the carton 90 has been removed. In detaching the removable portion a portion of the first and second top panels 12*b*, 12*a*; a portion of the first and second side panels 14,18; and a portion of the second and fourth end closure panels 22*a*, 26*a*; and the first end closure panel 20*a* have been removed from the carton 90. The removable portion is dimensioned sufficiently to allow removal of an article A through the aperture created by its removal. It will be appreciated that the tab 50 has been removed from the first top panel 12*b* and this creates a recess R1 in the first top panel 12*b*. The aperture 64 in the first top panel 12*b* creates a recess in the second top panel 12*a* when the corner portion is removed. The recess in the first top panel 12*b* and the recess in the second top panel 12*a* together provide a user access to the void or gap between a pair of adjacent articles A in an uppermost row of the articles A to enable removal of the uppermost and endmost article A that is exposed by the removal of the corner portion. A similar recess R2 is defined in the second and fourth end closure panels 22*a*, 26*a* upon removal of the corner portion. This recess R2 allows access to the void or gap between a pair of adjacent articles A in an endmost column of the articles A to enable removal of the uppermost and endmost article A exposed by the removal of the corner portion.

It will be appreciated that the arrangement of the access means D and the handle structure H provide that the carton 90 may be carried by the handle even after removal of the corner portion, since removal of the corner portion does not affect the integrity of the handle structure H.

Figure 6:
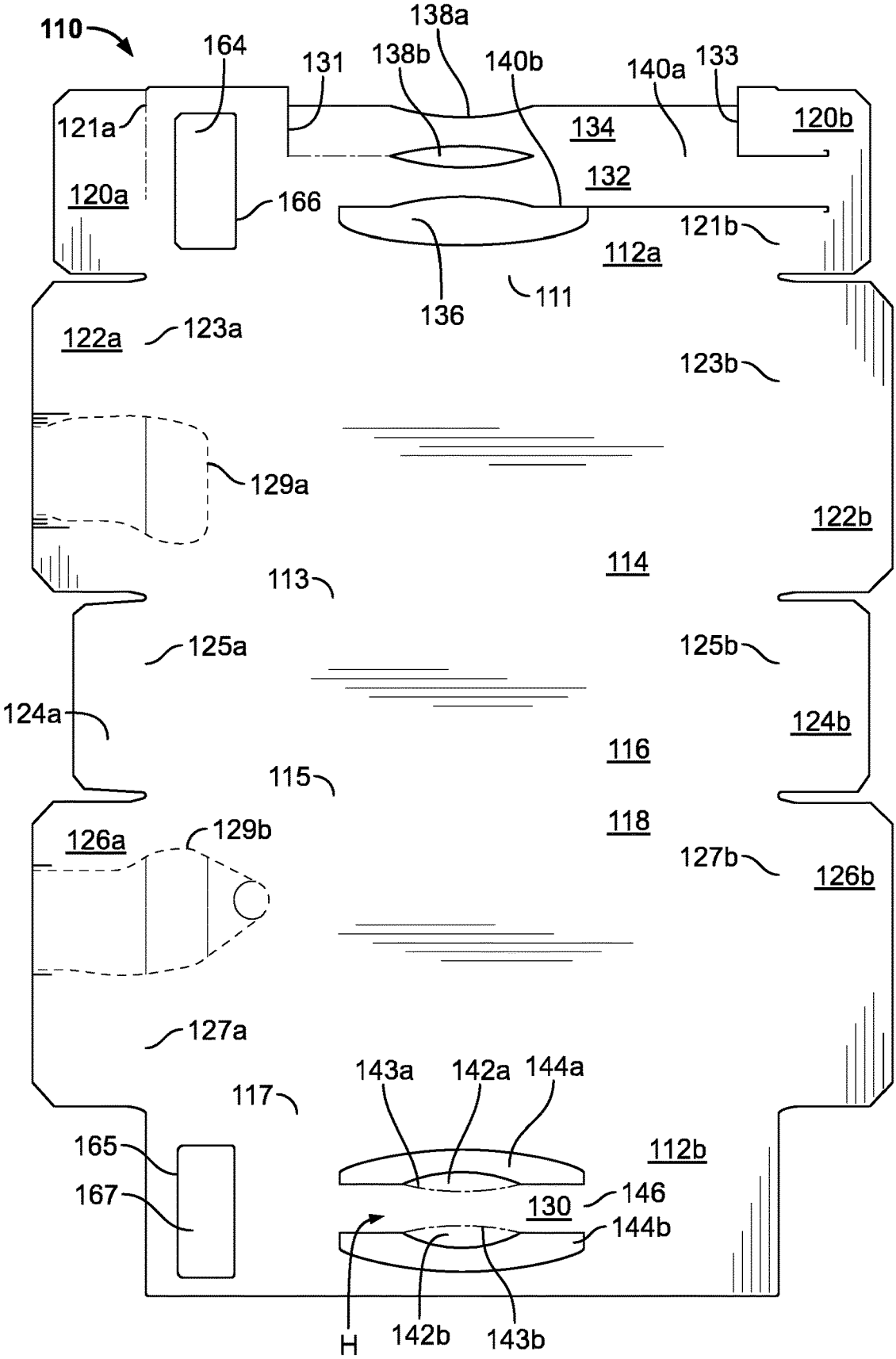
FIG. 6 is a plan view from above of a blank for forming a carton according to a second embodiment of the invention.

Referring now to FIG. 6, there is shown a second alternative embodiment of the present invention. In the second illustrated embodiment, like numerals have, where possible, been used to denote like parts, albeit with the addition of the prefix "100" to indicate that these features belong to the second embodiment respectively. The alternative embodiment shares many common features with the first embodiment and therefore only the differences from the embodiment illustrated in FIGS. 1 to 5 will be described in any greater detail.

FIG. 6 illustrates a blank 110 for forming a carton (not shown). The blank 110 comprises a plurality of main panels 112*a*, 112*b*, 114, 116, 118 forming; a second top panel 112*a*, a first side panel 114, a bottom panel 116 and a second side panel 118 and a first top panel 112*b* in set-up carton. A glue panel 120 is provided along a side edge of the second top panel 112*a* second top panel 112*a*. The second top panel 112*a* is hinged to the first side panel 114 by a fold line 111. The first side panel 114 is hinged to the bottom panel 116 by a fold line 113. The bottom panel 116 is hinged to the second side panel 118 by a fold line 115. The first top panel 112*b* is hinged to the second side panel 118 by a fold line 117.

The plurality of main panels 112*a*, 112*b*, 114, 116, 118 form a tubular structure in a set-up condition. Each of the ends of the tubular structure are at least partially closed by end closure panels 120*a*, 122*a*, 124*a*, 126*a* and 120*b*, 122*b*, 124*b*, 126*b*. End closure panels 120*a*, 122*a*, 124*a*, 126*a* are configured to close a first end of the tubular structure and end panels 120*b*, 122*b*, 124*b*, 126*b* are configured to close a second end of the tubular structure. A first end closure panel 120*a* is hinged to a first end of the second top panel 112*a* by a fold line 121*a*. A second end closure panel 122*a* is hinged to a first end of the first side panel 114 by a fold line 123*a*. A third end closure panel 124*a* is hinged to a first end of the bottom panel 116 by a fold line 125*a*. A fourth end closure panel 126*a* is hinged to a first end of the second side panel 118 by a fold line 127*a*.

A fifth end closure panel 120*b* is hinged to a second end of the second top panel 112*a* by a fold line 121*b*. A sixth end closure panel 122*b* is hinged to a second end of the first side panel 114 by a fold line 123*b*. A seventh end closure panel 124*b* is hinged to a second end of the bottom panel 116 by a fold line 125*b*. An eighth end closure panel 126*b* is hinged to a second end of the second side panel 118 by a fold line 127*b*.

In a set-up carton the second top panel 112*a* and the first top panel 112*b* form a composite top panel 112*a*/112*b*.

The second top panel 112*a* and the first top panel 112*b* each comprise an optional aperture 164, 167 respectively. First aperture 164 is defined by cut line 166 and second aperture 167 is defined by cut line 165. The first aperture 164 is disposed in a portion of the second top panel 112*a* between the fold line 121*a*, along which the first end closure panel 120*a* is hinged, and an end of the first inner strap 132 adjacent or closest to the first end closure panel 120*a*. The second aperture 167 is struck from a portion of the first top panel 112*b* and is configured to be disposed in registry with the first aperture 164 when the first and second top panels 112*a*, 112*b* are disposed in overlapping relationship with one another. The first and second apertures 164, 167 provide a display window through which the carton's contents are visible. The display window provides access to the article disposed therebeneath. The display window can be provided in the composite top panel 112*a*/112*b* without affecting the integrity of the handle structure H.

The blank 110 further comprises a first weakened line of severance 129*a* and a second weakened line of severance 129*b* which together form an access means D or dispenser in a set-up carton for facilitating access to the articles being packaged. The first weakened line of severance 129*a* and the second weakened line of severance 129*b* which together form a continuous loop in a set-up carton.

The first weakened line of severance 129*a* is provided in part in the first side panel 114 and in part in the second end closure panel 122*a*. First weakened line of severance 129*a* commences from a free end edge of the second end closure panel 122*a* extends across the second end closure panel 122*a* into the first side panel 114. The first weakened line of severance 129*a* is substantially "U" shaped. The first weakened line of severance 129*a* returns into the second end closure panel 122*a* extends across the second end closure panel 122*a* and terminates at the free end edge of the second end closure panel 122*a*.

The second weakened line of severance 129*b* is provided in part in the second side panel 118 and in part in the fourth end closure panel 126*a*. Second weakened line of severance 129*b* commences from a free end edge of the fourth end closure panel 126*a* extends across the fourth end closure panel 126*a* into the second side panel 118. The second weakened line of severance 129*b* is substantially "V" shaped in the second side panel 118. The second weakened line of severance 129*b* returns into the fourth end closure panel 128*a* extends across the fourth end closure panel 126*a* and terminates at the free end edge of the fourth end closure panel 126*a*. The second side panel 118 comprises an optional first arcuate fold line which arcuate fold line is substantially "C" shaped. Each end of the arcuate fold line intersects or meets with the second weakened line of severance 129*b*. Second side panel 118 comprises an optional linear fold line spaced from the "C" shaped fold line. Each end of the linear fold line intersects or meets with the second weakened line of severance 129*b*.

The access means D defined by the first and second weakened lines of severance 129*a*, 129*b*, is arranged to be in closer proximity to the bottom panel 116 than to the composite top panel 112*a*/112*b*. In alternative embodiments the access means D may be arranged to be in closer proximity to the composite top panel 112*a*/112*b* or evenly spaced. It will be appreciated that the access means D can be arranged to be in closer proximity to the composite top panel 112*a*/112*b* without affecting the integrity of the handle structure H.

It will also be appreciated that in the foregoing embodiments the handle structure H can be employed irrespective of the condition of the access means D. That is to say the handle structure H can be employed when the access means D is in an intact or inactive condition (that is to say the handle structure H can be employed prior to detachment of the corner portion) and when the access means D is in a severed or active condition (the handle structure H can be employed when the corner portion D has been detached). Deployment of the handle structure H does not affect the access means whether in the active or inactive condition. Similarly the access means D can be employed irrespective of the condition of the handle structure H. The access means D can be activated without affecting the integrity of the handle structure H. Deployment of the handle structure does not affect the access means D, the corner portion D of the carton 90 can be detached when the handle structure H is in an operative position and when in a stowed position; the corner portion D of the carton 90 can be detached prior to activation of the handle structure, that is to say before the weakened line of severance 46, 146 is severed.

Referring now to FIGS. 7 to 10, there is shown a third embodiment of the present invention. In the third illustrated embodiment, like numerals have, where possible, been used to denote like parts, albeit with the addition of the prefix "300" to indicate that these features belong to the third embodiment respectively. The third embodiment shares many common features with the first embodiment and therefore only the differences from the first embodiment illustrated in FIGS. 1 to 5 will be described in any greater detail.

Figure 7:
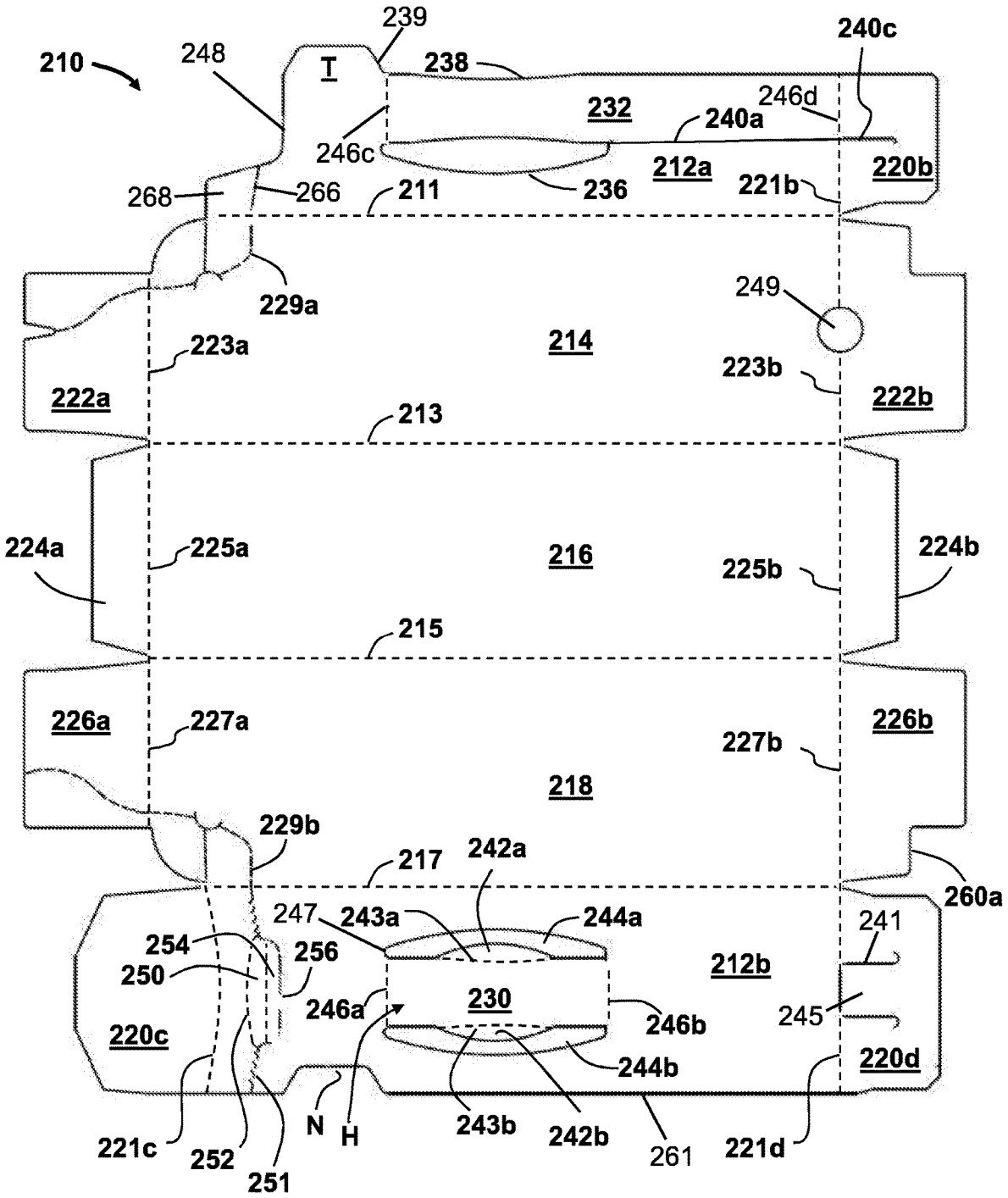
FIG. 7 is a plan view from above of a blank for forming a carton according to a third embodiment of the invention.
Figure 9:
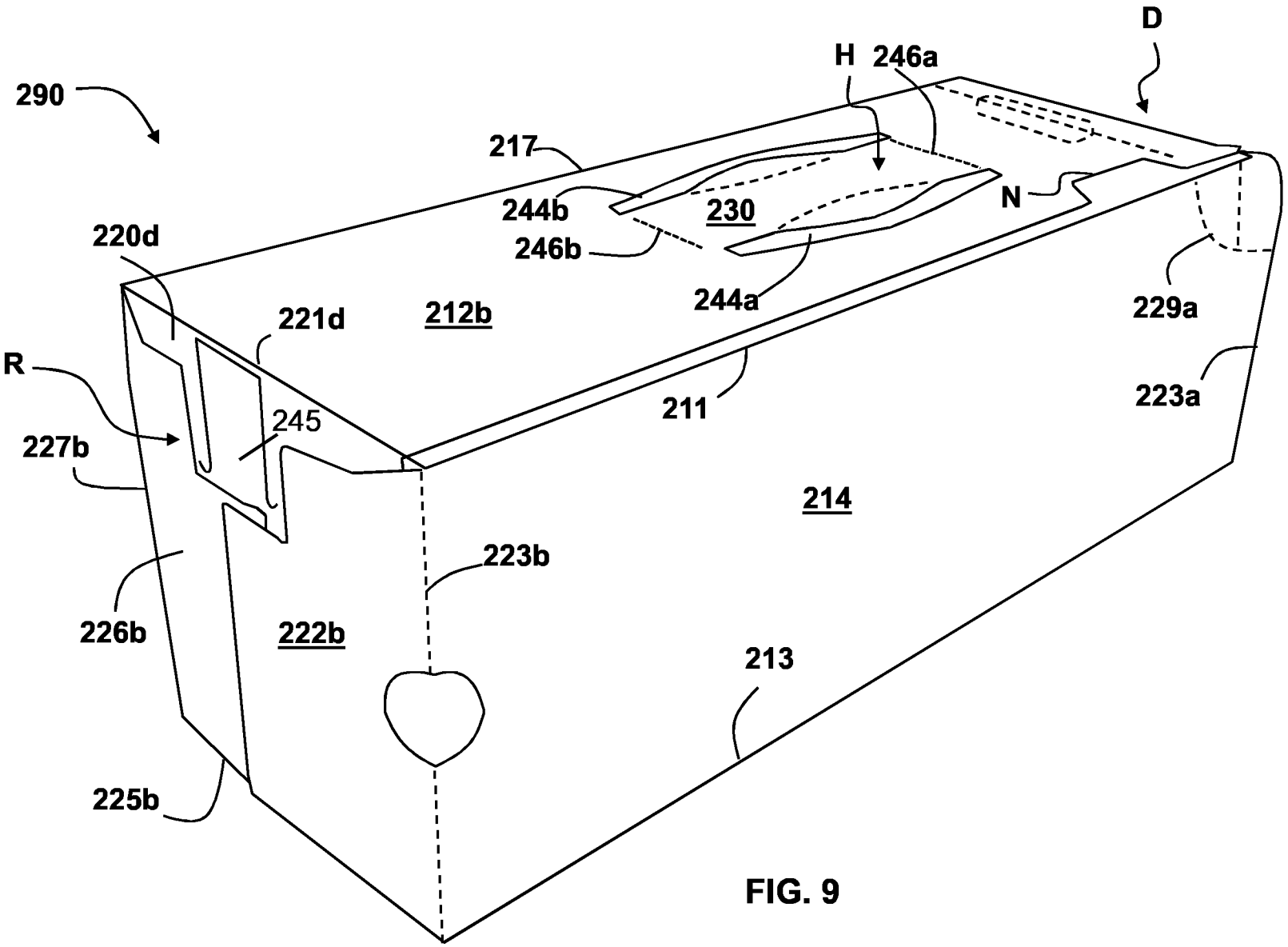
FIG. 9 is a perspective view of the carton formed from the blank of FIG. 7, showing a first end wall of the carton wherein a displaceable tab is exposed to view in a recess formed by respective cutaway portions in the side end closure panels of that end wall.
Figure 10:
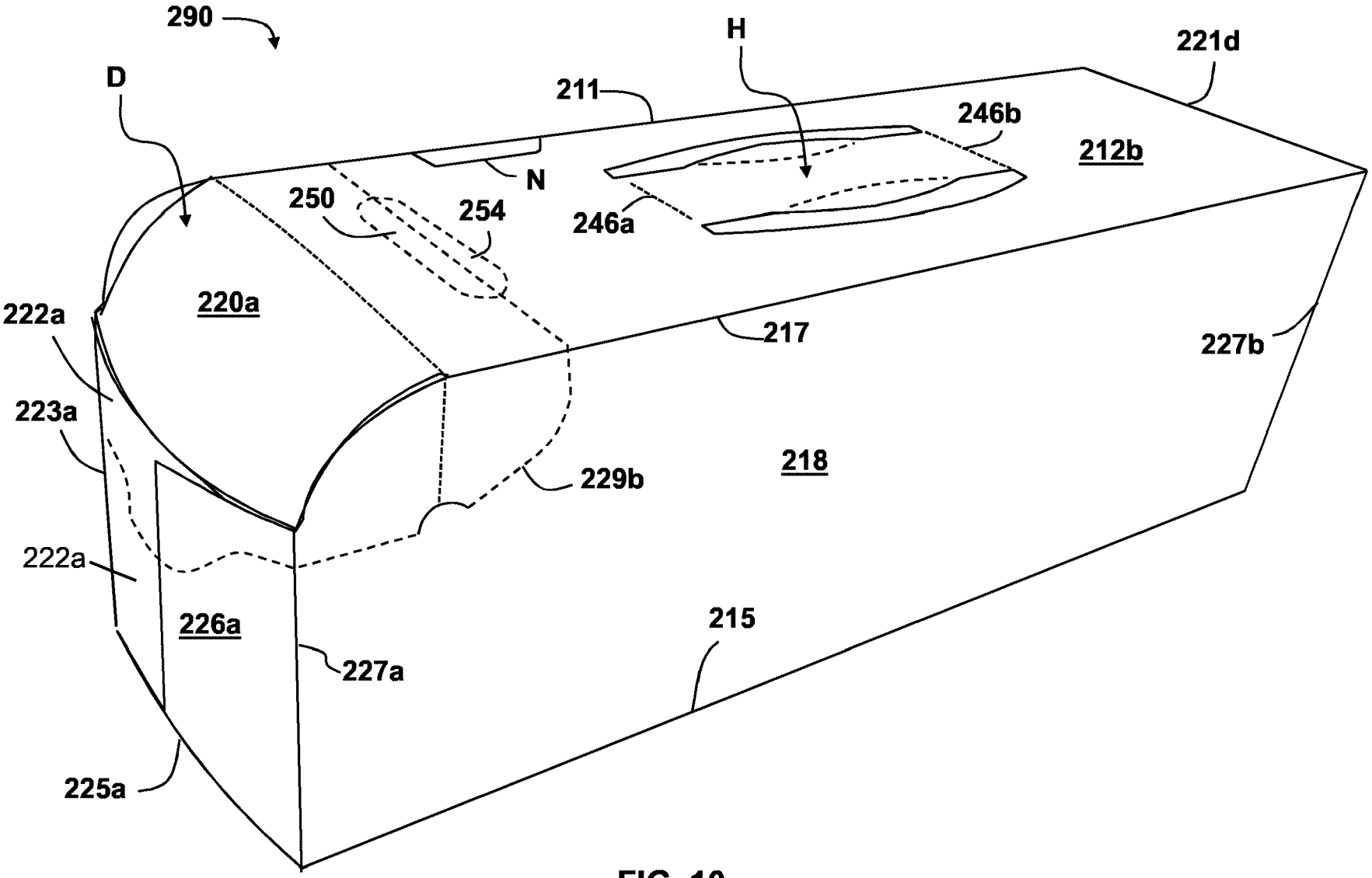
FIG. 10 is a perspective view of the carton formed from the blank of FIG. 7, showing a second end wall having a rounded upper end corner from which an access device is formed.

Referring to FIG. 7, the blank 210 is configured to form a carton or carrier 290 (FIGS. 9 and 10) for packaging an exemplary arrangement of exemplary articles. In the carton of FIGS. 9 and 10, twelve cans of the arrangement of a 2×6 matrix are packaged. The blank 210 of FIG. 7 can be alternatively configured to form a carrier for packaging other types, number and size of article and/or for packaging articles in a different arrangement or configuration.

Referring further to FIG. 7, the blank 210 comprises a plurality of main panels 212*a*, 212*b*, 214, 216, 218 for forming: a second top panel 212*a*, a first side wall 214, a bottom wall 216, a second side wall 218 and a first top panel 212*b* in set-up carton 290. The main panels 212*a*, 212*b*, 214, 216, 218 form a tubular structure in a set-up condition. Each of the ends of the tubular structure are at least partially closed by end closure panels 222*a*, 224*a*, 226*a*, 220*c* and 220*b*, 222*b*, 224*b*, 226*b*, 220*d*. End closure panels 222*a*, 224*a*, 226*a*, 220*c* are configured to form a first end wall to close, at least in part, a first end of the tubular structure and end closure panels 220*b*, 222*b*, 224*b*, 226*b*, 220*d* are configured to form a second end wall to close, at least in part, a second end of the tubular structure. The first end wall, however, differs from that of the first embodiment in that the first end wall of the carton 290 is associated with a rounded upper-end corner provided by the warped top end closure panel 220*c* which is convexly curved as viewed from the outside of the carton 290 (FIG. 10). The top end closure panel 220*c* is hinged to the first end of the outer top panel 212*b* by a curved fold line 221*c*. One of the four corners of each of the side panels 214, 218 is also rounded to cooperate with the top end closure panel 220*c* to form the rounded upper-end corner of the carton 290. The access device or dispensing feature D of the carton 290 is formed in the rounded corner as bets shown in FIG. 10.

Returning to FIG. 7, an inner end closure panel 220*b* is hinged to the second end of the inner top panel 212*a* by a fold line 221*b*. However, no end closure panel is hinged to the first end of the inner top panel 212*a*. Instead, the outer top end closure panel 220*c* serves to provide part of the first end wall. Since the inner end closure panel 220*b* is a half-size panel or a partial end closure flap, the outer top panel 212*b* is provided with a full-size, outer end closure panel 220*d* at its second end. The outer top end closure panel 220*d* is hingedly connected to the second end of the outer top closure panel 212*b* along a fold line 221*d*. The outer top end closure panel 220*d* is provided with a generally U-shaped severance line 241 for defining a displaceable tab 245 in the outer top end closure panel 220*d*. The displaceable tab 245 is attached to the end of the inner handle strap 232 adjacent to the fold line 246*d*, when the carton 290 is set up, to reinforce the joint at that end between the handle H and the second end wall of the carton 290. The displaceable tab 245 is swingable inwardly of the carton when attached to the handle end and when the handle H is pulled upwards. By that means the displaceable tab 245 allow the handle H to be somewhat slacked to provide a hand room under its gripping area corresponding to the outer strap 230.

Referring further to FIG. 7, the handle or handle structure H is provided in part by respective portions of the inner top panel 212*a* and the outer top panel 212*b*. Those respective portions are the inner and outer handle straps 232, 230. The outer handle strap 230 is defined at least in part by the first and second outer apertures 244*a*, 244*b* in the outer top panel 212*b* such that it is provided by that portion of the outer top panel 212*b* between the outer apertures 244*a*, 244*b*. The outer handle strap 230 is provided with a pair of hingedly connected cushioning flaps 242*a*, 242*b* and connected at its one end to the outer top panel 212*b* by a fold line 246*a* and at the other end by a frangible connection such as a severance line 246*b*. The inner handle strap 232 is formed in part from the inner top panel 212*a* and in part from the inner end closure panel 220*b*. The inner strap 232 is defined in part by an inner aperture 236 in the inner top panel 212*a* and in part by a severance line such as a cut line 240*a*. The cut line 240*a* extends from the aperture 236 across the inner top panel 212*a*. It continuously extends into the inner top end closure panel 220*b* and turns into the cut line 240*c*. The inner handle strap 232 is connected at its one end to the inner top panel 212*a* by a fold line 246*c* and at its other end to the inner top end closure panel 220*b* by a fold line 246*d*.

Figure 8:
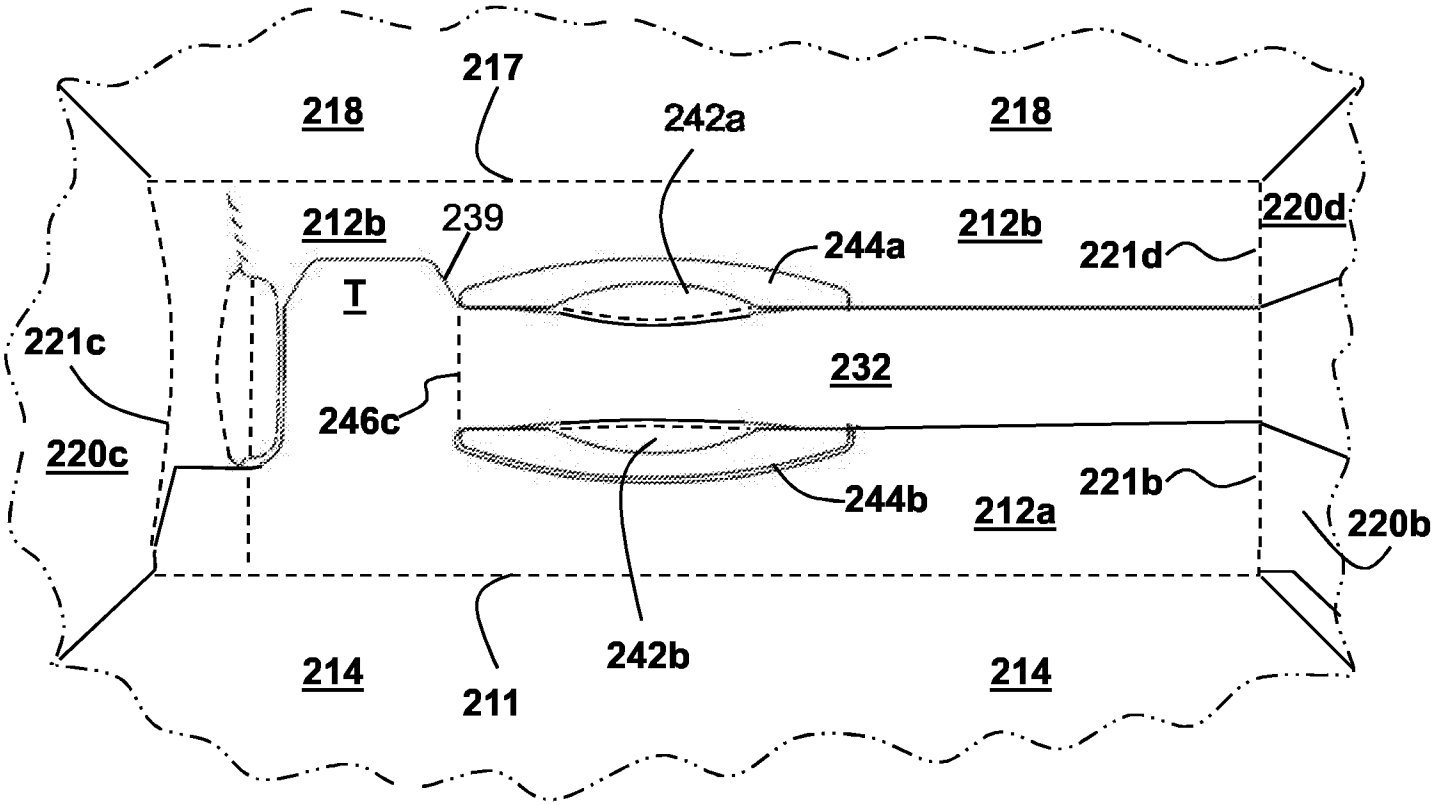
FIG. 8 is a perspective view of the inside of a carton erected from the blank of FIG. 7, showing a top wall of the carton viewed from below.

Referring again to FIG. 7, the portion of the inner top panel 212*a* adjacent to the one end of the inner handle strap 232 is provided with a reinforcing tab "T" which extends away from the fold line 211 between the inner top panel 212*a* and the side panel 214. With respect to the length, or a notional longitudinal line, of the inner handle strap 232, the reinforcing tab "T" extends transversely outward from the proximity of the one end of the inner strap 232 such that a reinforcing edge 239 is provided by the tab "T". The tab "T" is shaped and dimensioned such that the reinforcing edge 239 is positioned in general alignment with one end 247 of the outer aperture 244*a* when the blank 210 is erected into the carton 290. The reinforcing edge placed in general alignment with the one end is best shown in FIG. 8. In the position shown in FIG. 8, tab "T" effectively reinforce the one end area of the outer top panel 212*b* so that the chance of a tear to develop from the one end 247 toward the access device D is substantially reduced. A recess "N" is defined in the outer top panel 212*b* along the free side edge 261 of the outer top panel 212*b* as a result of forming a like reinforcing tab of a like blank from the outer top panel 212*b*. The like blank may be nested with the blank 210 when those blanks are cut from the same sheet of foldable material. The recess "N" is complementary in terms of shape and size to the reinforcing tab "T".

The inner top panel 212*a* is further provided with an end recess or cutout 248 at its one end next to the reinforcing tab "T". The end recess 248 generally registers with the tear initiation tab 250 in the outer top panel 212*b* so as to facilitate breaking of the tear initiation tab 250 along the severance line 256. The shape and dimension of the recess 248 may be such that the edge of the recess extends at least in part along the outline of the tear initiation tab 250 when the carton is erected, which is best shown in FIG. 8. In the arrangement shown in FIG. 8, part of the edge of the recess 248 serves as a cutting guide for the severance line 256.

Reference numeral "249" denotes an opening that may be used as a finger aperture for a consumer to engage his/her finger in order to pull the carton 290 from a store shelf or a stack of like cartons. Reference numeral "266" denotes a severance line which defines a detachable portion 268 of the inner top panel 212*a*. The detachable portion 268 forms a part of the access device D (FIG. 10) when the blank is erected into the carton 290.

FIGS. 9 and 10 illustrate the carton 290 formed from the blank 210. How to assemble and use the carton 290 and handle H is similar, if not identical, to the first embodiment.

It can be appreciated that various changes may be made within the scope of the present invention, for example, the size and shape of the panels and apertures may be adjusted to accommodate articles of differing size or shape. In particular it is envisaged that the handle structure and access device may be employed in variety carton styles including but not limited to fully enclosed cartons, wrap around cartons, basket carrier style carton, top gripping cartons.

It will be recognised that as used herein, directional references such as "top", "bottom", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. A fold line is typically a scored line, an embossed line, or a debossed line. Any reference to hinged connection or fold line should not be construed as necessarily referring to a single fold line only; indeed it is envisaged that hinged connection can be formed from any one or more of the following, a short slit, a frangible line or a fold line without departing from the scope of the invention.

As used herein, the terms "severance line" and "weakened line of severance" refer to all manner of lines that facilitate separating portions of the substrate from one another or that indicate optimal separation locations. Severance lines may be frangible or otherwise weakened lines, tear lines, cut lines, or slits.

It should be understood that hinged connection, severance lines and fold lines can each include elements that are formed in the substrate of the blank including perforations, a line of perforations, a line of short slits, a line of half-cuts, a single half-cut, a cut line, an interrupted cut line, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The invention claimed is:

1. A carton for packaging one or more articles, the carton comprising a plurality of walls including a top wall, a first side wall, a second side wall, at least an end wall, and a bottom wall, the carton further comprising a handle structure, the handle structure comprising an outer handle strap and an inner handle strap, the outer handle strap being defined at least in part in an outer panel of the top wall, and the inner handle strap being defined at least in part in an inner panel of the top wall, the outer panel being disposed in at least partially overlapping relationship with the inner panel to form the top wall, the outer handle strap having first and second opposed ends spaced from one another opposite a longitudinal length of the outer handle strap and being continuously formed with the outer panel at the first end and severably attached by a frangible connection to the outer panel at the second end, the inner handle strap comprising a first end disposed in the inner panel and continuously formed with the inner panel, the inner handle strap comprising a second end spaced apart from the first end of the inner handle strap opposite a longitudinal length of the inner handle strap, the second end of the inner handle strap disposed in the at least one end wall, the outer handle strap being secured to the inner handle strap, the handle structure comprising a central portion defined by the outer handle strap, the central portion being displaceable out of the plane of the top wall upon severance of the frangible connection, the carton further comprising an access device formed at least in part from the top wall, the access device being disposed adjacent to the first end of the outer handle strap.

2. The carton according to claim 1 wherein the handle structure further comprises a reinforcing strap hinged to the inner handle strap.

3. The carton according to claim 2 wherein the reinforcing strap is struck at least in part from the inner panel.

4. The carton according to claim 1 wherein the at least one end wall comprises a top end closure panel and a first side end closure panel, the first side end closure panel having a first cutaway portion configured and arranged to expose an end portion of the inner handle strap.

5. The carton according to claim 4 wherein the at least one end wall further comprises a second side end closure panel, the second side end closure panel having a second cutaway portion configured and arranged to expose the end portion of the inner handle strap.

6. The carton according to claim 1 wherein the access device comprises a detachable portion of the top wall.

7. The carton according to claim 6 wherein the at least one end wall comprises first and second opposed end walls, and the access device further comprises a detachable portion of the first side wall, a detachable portion of the second side wall and a detachable portion of the first end wall so as to form a removable corner portion.

8. A blank comprising a plurality of panels for forming a carton which includes a top wall, a first side wall, a second side wall, at least one end wall and a bottom wall, the plurality of panels of the blank include inner and outer panels and a top end closure panel, the inner and outer panels being disposed in at least partially overlapping relationship to form the top wall when the blank is erected into a carton, the end closure panel providing at least a part of the at least one end wall when the blank is erected into a carton, the blank further comprising a handle structure including inner and outer handle straps, the outer handle strap being defined at least in part in the outer panel, and the inner handle strap being defined at least in part in the inner panel, the outer handle strap having first and second opposed ends spaced from one another opposite a longitudinal length of the outer handle strap and being continuously formed with the outer panel at the first end and severably attached by a frangible connection to the outer panel at the second end, the inner handle strap comprising a first end disposed in the inner panel and continuously formed with the inner panel, the inner handle strap comprising a second end spaced apart from the first end of the inner handle strap opposite a longitudinal length of the inner handle strap, the second end of the inner handle strap disposed in the top end closure panel, the outer handle strap being arranged to be securable to the inner handle strap, the handle structure having a central portion defined by the outer handle strap, the central portion, in a set-up carton, is displaceable out of the plane of the outer panel upon severance of the frangible connection, the blank further comprising an access device defined at least in part in the outer panel and at least in part in the inner panel, the access device being disposed adjacent to the first end of the outer handle strap.

9. The blank according to claim 8 wherein the access device comprises a detachable portion of the top wall.

10. The blank according to claim 9 wherein the at least one end wall comprises first end second opposed end walls of a carton, and the access device further comprises a detachable portion of the first side wall, a detachable portion of the second side wall and a detachable portion of the first end wall so as to form a removable corner portion.

* * * * *